US006854215B1

(12) United States Patent
Kaiser

(10) Patent No.: US 6,854,215 B1
(45) Date of Patent: Feb. 15, 2005

(54) HOLLOW METAL DOOR HAVING FOAM RETAINED TAPPING STRUCTURE

(75) Inventor: David A. Kaiser, Walkerton, IN (US)

(73) Assignee: Plyco Corporation, Elkhart Lake, WI (US)

( * ) Notice: Subject to any disclaimer, the term of this patent is extended or adjusted under 35 U.S.C. 154(b) by 204 days.

(21) Appl. No.: 10/246,334

(22) Filed: Sep. 17, 2002

(51) Int. Cl.[7] ..... E06B 3/00; E06B 1/04

(52) U.S. Cl. ..... 49/506; 49/504; 52/364; 52/366; 52/309.7

(58) Field of Search ..... 49/506, 504, 505, 49/339, 340, 501; 52/364, 366, 309.7, 784.1, 797.1

(56) References Cited

U.S. PATENT DOCUMENTS 2,833,004 A * 5/1958 Johnson et al. ..... 49/504
3,400,492 A * 9/1968 Bell et al. ..... 49/504
3,885,351 A * 5/1975 Imperial et al. ..... 49/501
3,987,588 A * 10/1976 Imperial et al. ..... 49/501
4,888,918 A * 12/1989 Green et al. ..... 49/501
6,668,499 B2 * 12/2003 Degelsegger ..... 49/501

FOREIGN PATENT DOCUMENTS

GB 2183706 * 6/1987 ..... 49/501 X

* cited by examiner

*Primary Examiner*—Hugh B. Thompson, II
(74) *Attorney, Agent, or Firm*—Donald J. Ersler

(57) ABSTRACT

A hollow metal door having a foam retained tapping structure includes a hollow metal door, at least one tapping structure, and a quantity of foam injected into the hollow metal door. The hollow metal door includes a pan member and a lid member which is attached to the pan member to form the hollow metal door. The tapping structure preferably includes a fastening tube and an attachment pedestal extending from the fastening tube. A bottom of the pedestal is attached to an inside perimeter wall of the pan member adjacent where a door component is to be attached. The tapping structure is preferably attached to the inside perimeter wall of the pan member with double sided tape, but other fastening methods may also be used.

14 Claims, 8 Drawing Sheets

HOLLOW METAL DOOR HAVING FOAM RETAINED TAPPING STRUCTURE

BACKGROUND OF THE INVENTION

1. Field of the Invention

The present invention relates generally to hollow metal doors and more specifically to a hollow metal door having a foam retained tapping structure, which enables door components to be rigidly fastened thereto.

2. Discussion of the Prior Art

A hollow metal door is typically lined on an inside perimeter wall with wood strips. Door components attached to the hollow metal door, such as a closer or panic bar are secured to the hollow metal door with fasteners threaded into the wood strip. Unfortunately, a wood strip absorbs moisture and will expand. Expansion of the wood strip will cause the hollow metal door to bulge, which is unacceptable. Wood strips frequently rot. A rotted wood strip requires the reattachment of the door component to an area of the wood, which is not rotted.

Accordingly, there is a clearly felt need in the art for a hollow metal door having a foam retained tapping structure, which uses a tapping structure fabricated from a material stronger than wood that does not absorb moisture, or rot.

SUMMARY OF THE INVENTION

The present invention provides a hollow metal door having a foam retained tapping structure, which does not absorb moisture. The hollow metal door having a foam retained tapping structure includes a hollow metal door, at least one tapping structure, and a quantity of foam injected into the hollow metal door. The hollow metal door includes a pan member and a lid member which is attached to the pan member to form the hollow metal door. The tapping structure preferably includes a fastening tube and an attachment pedestal extending from the fastening tube. A bottom of the attachment pedestal is attached to an inside perimeter wall of the pan member, adjacent where a door component is to be attached. The tapping structure is preferably attached to an inside perimeter wall of the pan member with double sided tape, but other fastening methods may also be used.

The hollow metal door having a foam retained tapping structure is preferably assembled in the following way. First, the at least one tapping structure is secured to the pan member. Next, the lid member is secured to the pan member. Finally, the hollow metal door is injected with blown foam. The foam fills inner and outer perimeters of the tapping structure and securely retains thereof in place.

Accordingly, it is an object of the present invention to provide a hollow metal door with a tapping structure that is stronger than a wood strip.

It is a further object of the present invention to provide a hollow metal door with a tapping structure that does not does not absorb moisture.

Finally, it is another object of the present invention to provide a hollow metal door with a tapping structure that does not corrode or rot.

These and additional objects, advantages, features and benefits of the present invention will become apparent from the following specification.

DETAILED DESCRIPTION OF THE PREFERRED EMBODIMENTS

Figure 1:
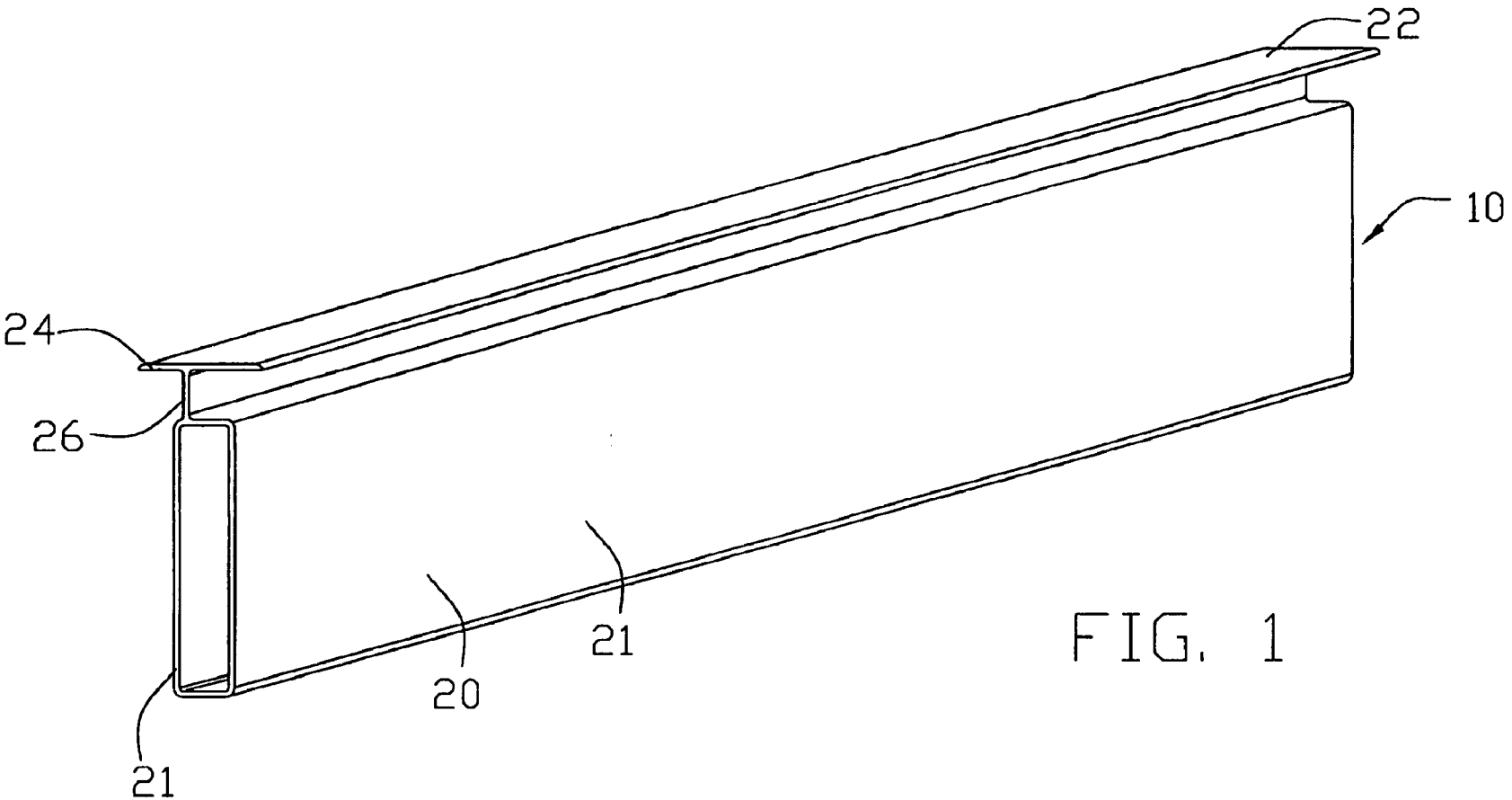
FIG. 1 is a perspective view of a tapping structure in accordance with the present invention.
Figure 2:
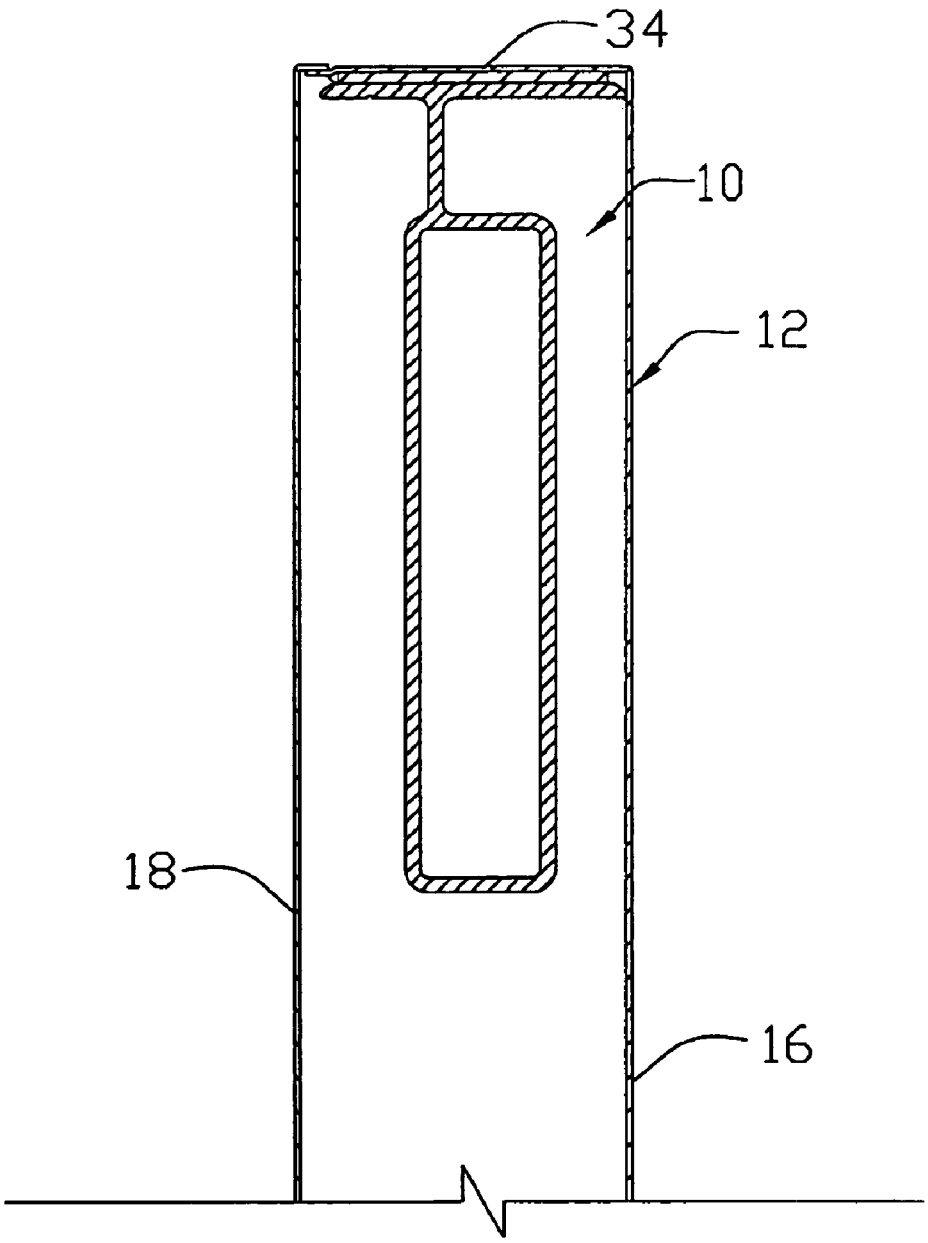
FIG. 2 is a cross sectional view of a hollow metal door with a tapping structure attached to an inside perimeter wall of a pan member, before injection of foam in accordance with the present invention.
Figure 3:
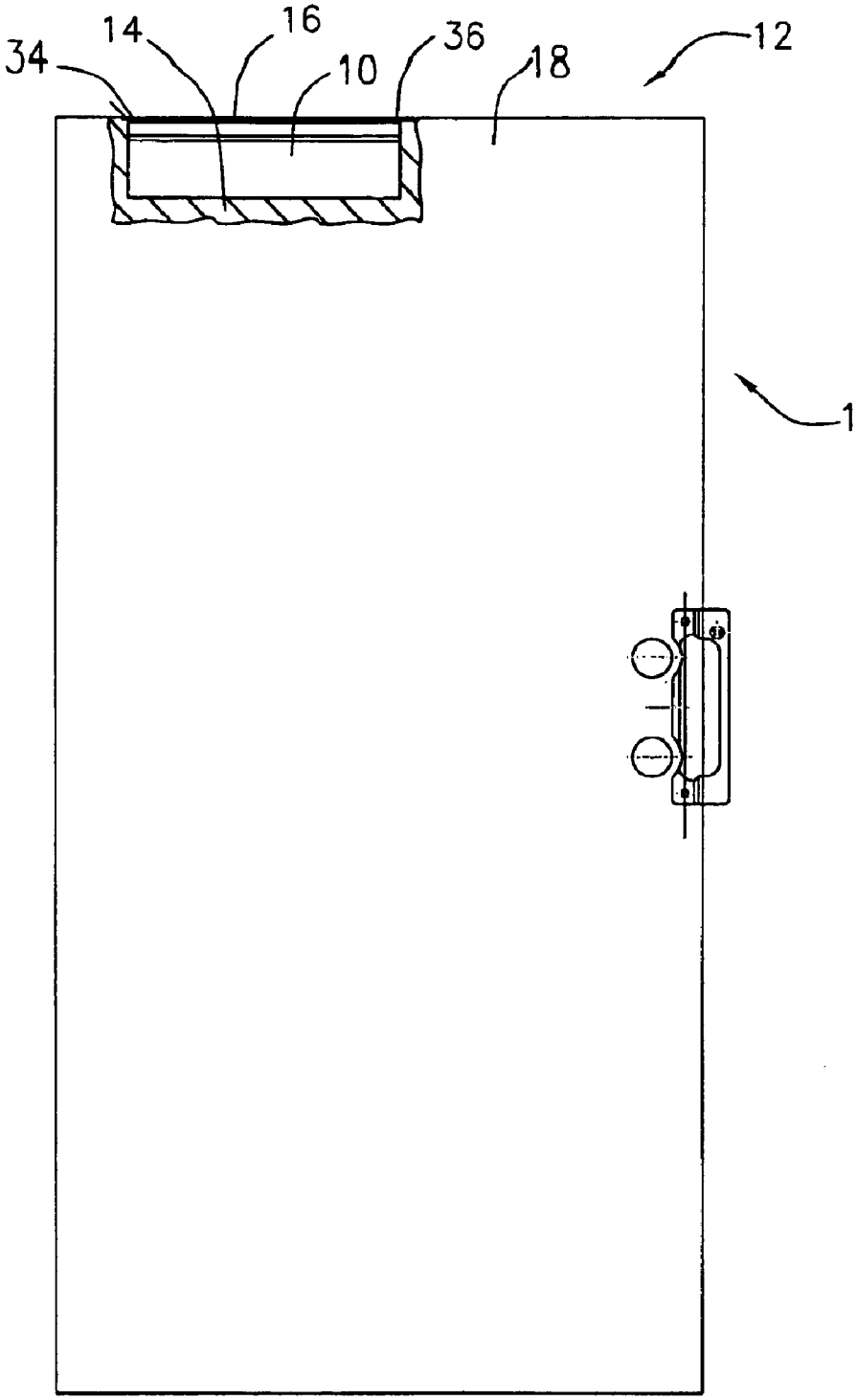
FIG. 3 is a front view of a hollow metal door with a cutaway portion revealing a tapping structure in accordance with the present invention.
Figure 4:
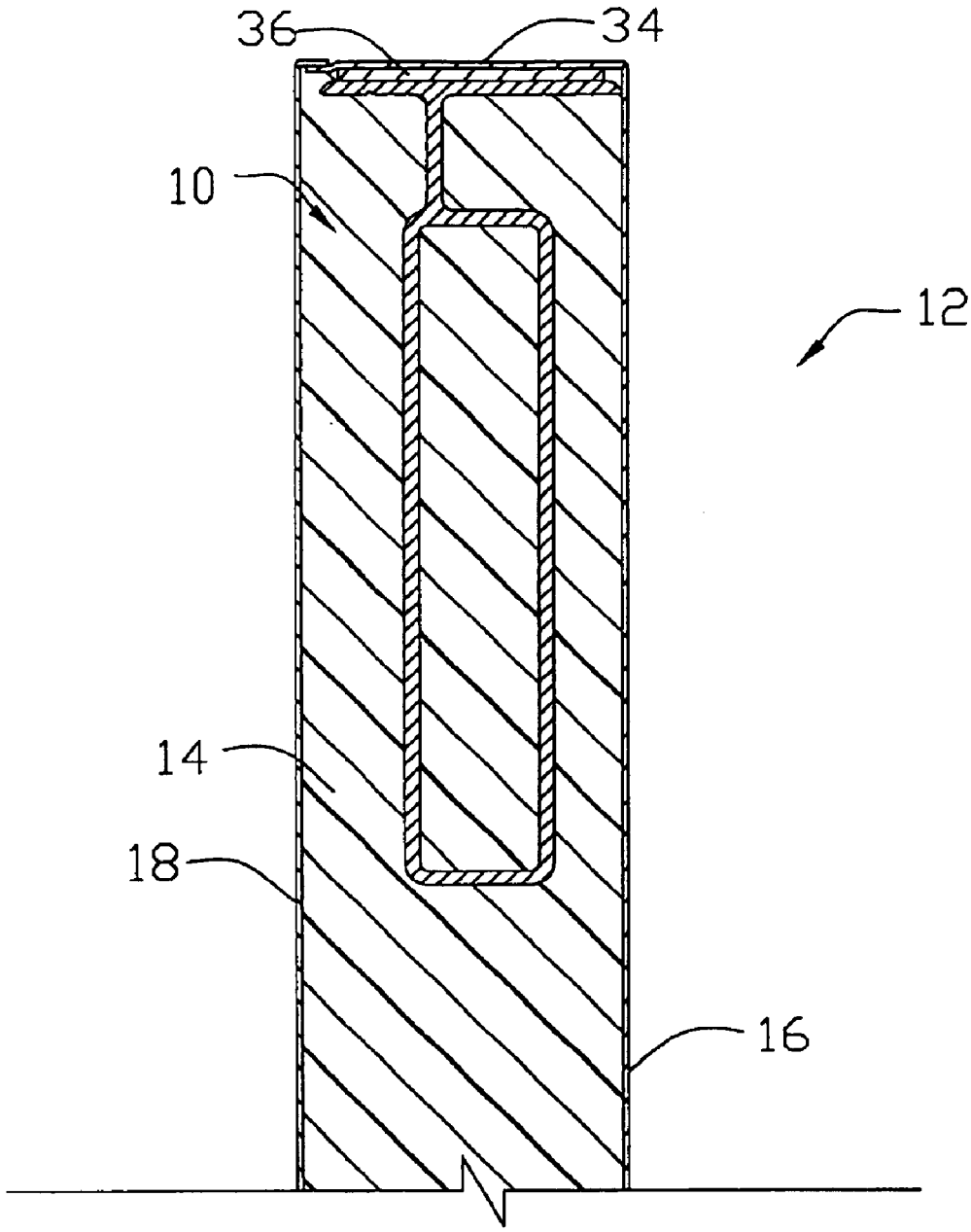
FIG. 4 is a cross sectional view of a hollow metal door with a tapping structure attached to an inside perimeter wall of a pan member, after injection of foam in accordance with the present invention.

With reference now to the drawings, and particularly to FIG. 1, there is shown a perspective view of a tapping structure 10. With reference to FIGS. 2–4, a hollow metal door having a foam retained tapping structure 1 includes a hollow metal door 12, the at least one tapping structure 10, and a quantity of foam 14 injected into the hollow metal door 12. The hollow metal door 12 includes a pan member 16 and a lid member 18, which is attached to the pan member 16 to form the hollow metal door 12. Hollow metal doors 12 are well known in the art and need not be explained in detail. The tapping structure 10 preferably includes a fastening tube 20 and an attachment pedestal 22, which extends from the fastening tube 20. The fastening tube 20 preferably has the shape of a rectangle, but other shapes may also be used. The fastening tube 20 includes two fastening walls 21. The attachment pedestal 22 includes a mounting base 24 and an attachment member 26. One edge of the attachment member 26 is joined to the fastening tube 20 and the other edge is joined to the base member 24. The attachment member 26 is preferably located off the center of the fastening tube 20 to provide better foam flow around the fastening tube 20. Preferably, the tapping structure 10 is fabricated from an aluminum extrusion, but other manufacturing methods and materials may also be used.

Figure 1A:
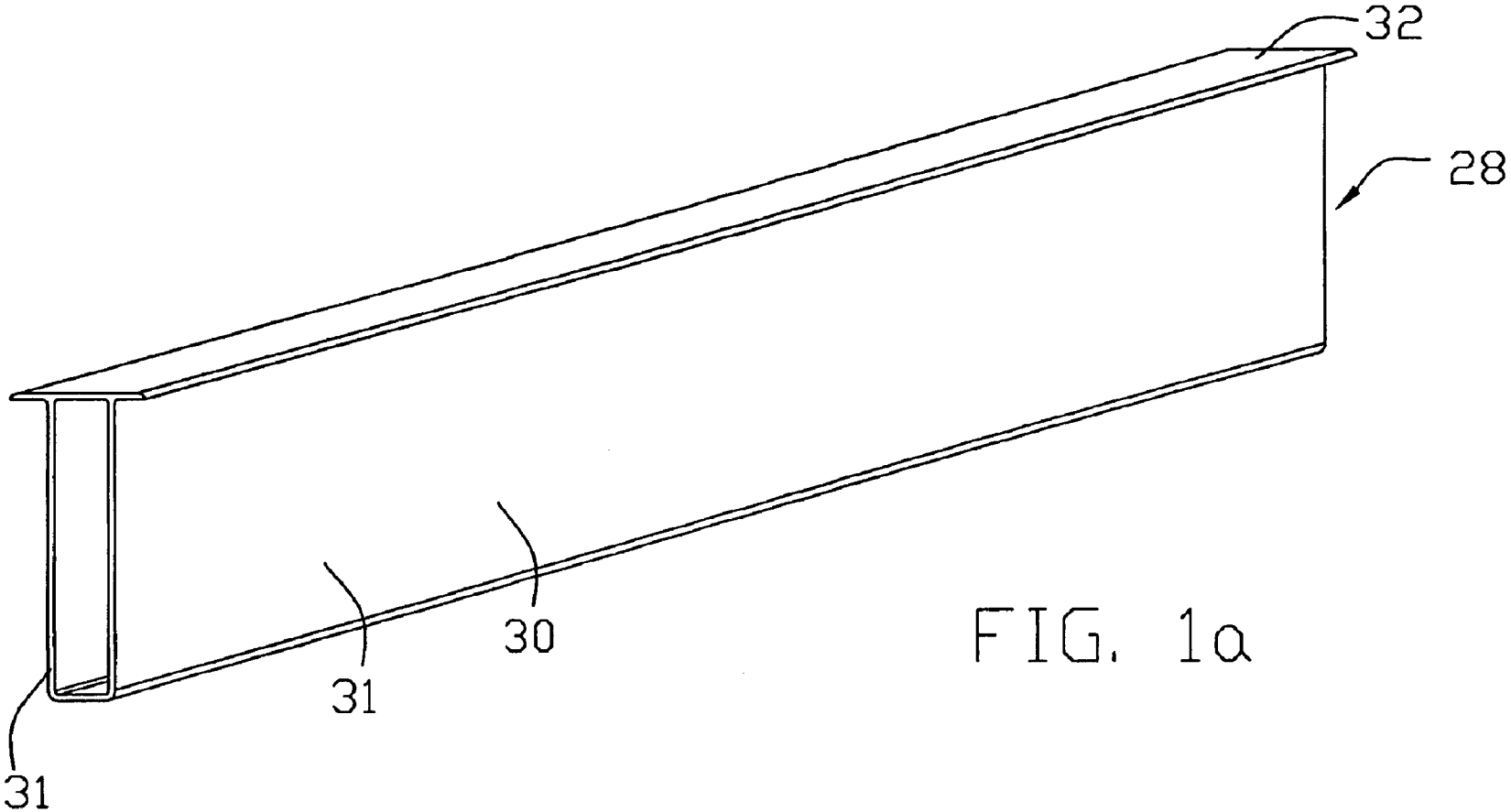
FIG. 1*a* is a perspective view of a second embodiment of a tapping structure in accordance with the present invention.

With reference to FIG. 1*a*, a second embodiment of a tapping structure 28 includes a fastening tube 30 and a mounting surface 32 formed on a perimeter of the fastening tube 30. The fastening tube 30 preferably has the shape of a rectangle, but other shapes may also be used. The fastening tube 30 includes two fastening walls 31. Preferably, the tapping structure 28 is fabricated from an aluminum extrusion, but other manufacturing methods and materials may also be used.

Figure 5:
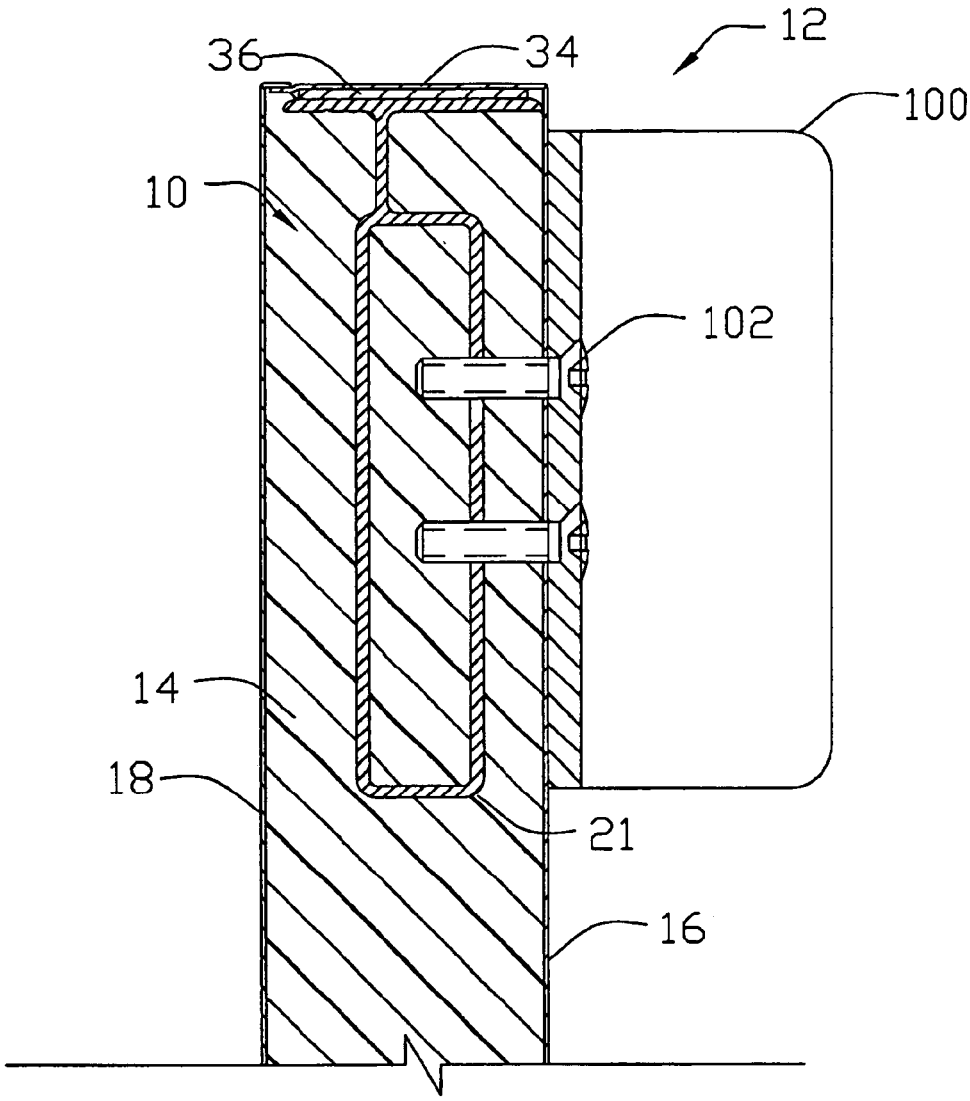
FIG. 5 is a cross sectional view of a hollow metal door with a tapping structure attached to an inside perimeter wall of a pan member and with fasteners retained by a single fastening wall of the tapping structure in accordance with the present invention.
Figure 6:
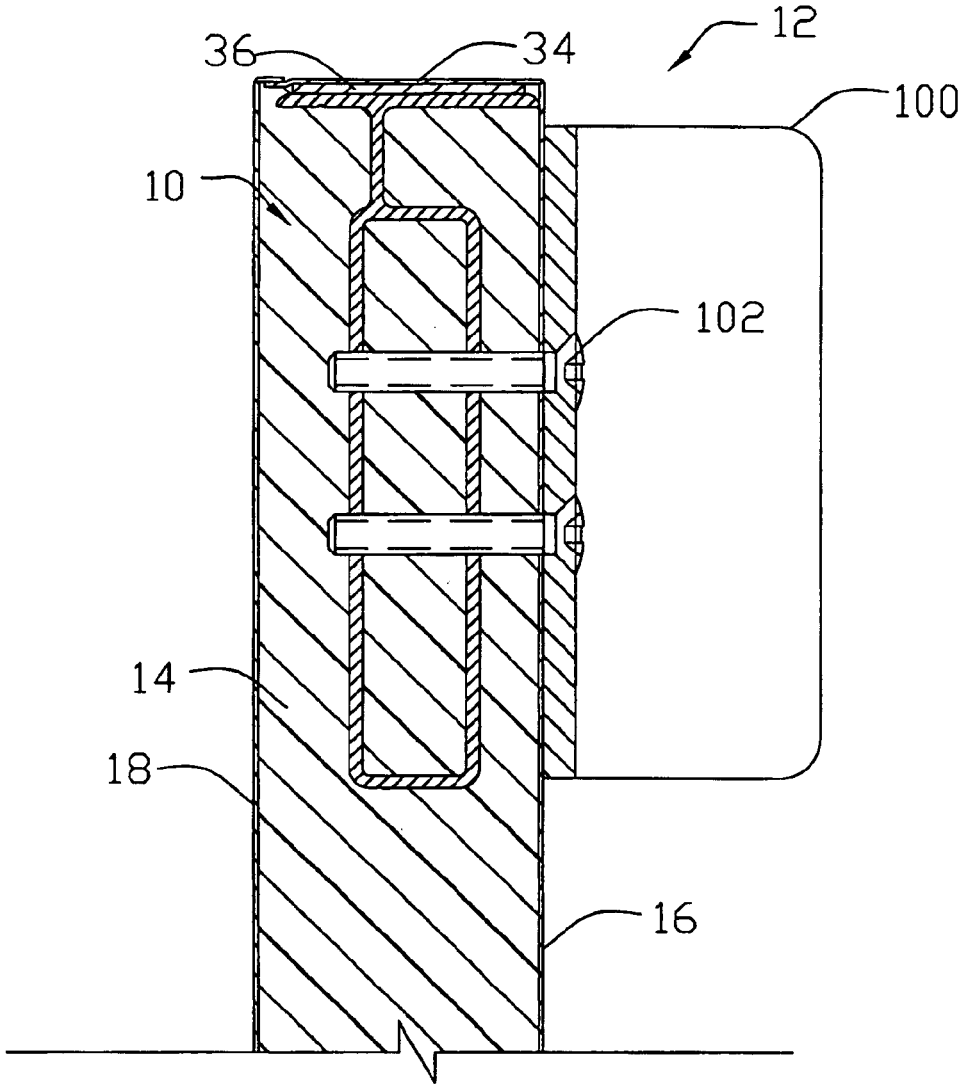
FIG. 6 is a cross sectional view of a hollow metal door with a tapping structure attached to an inside perimeter wall of a pan member and with fasteners retained by two fastening walls of the tapping structure in accordance with the present invention.
Figure 7:
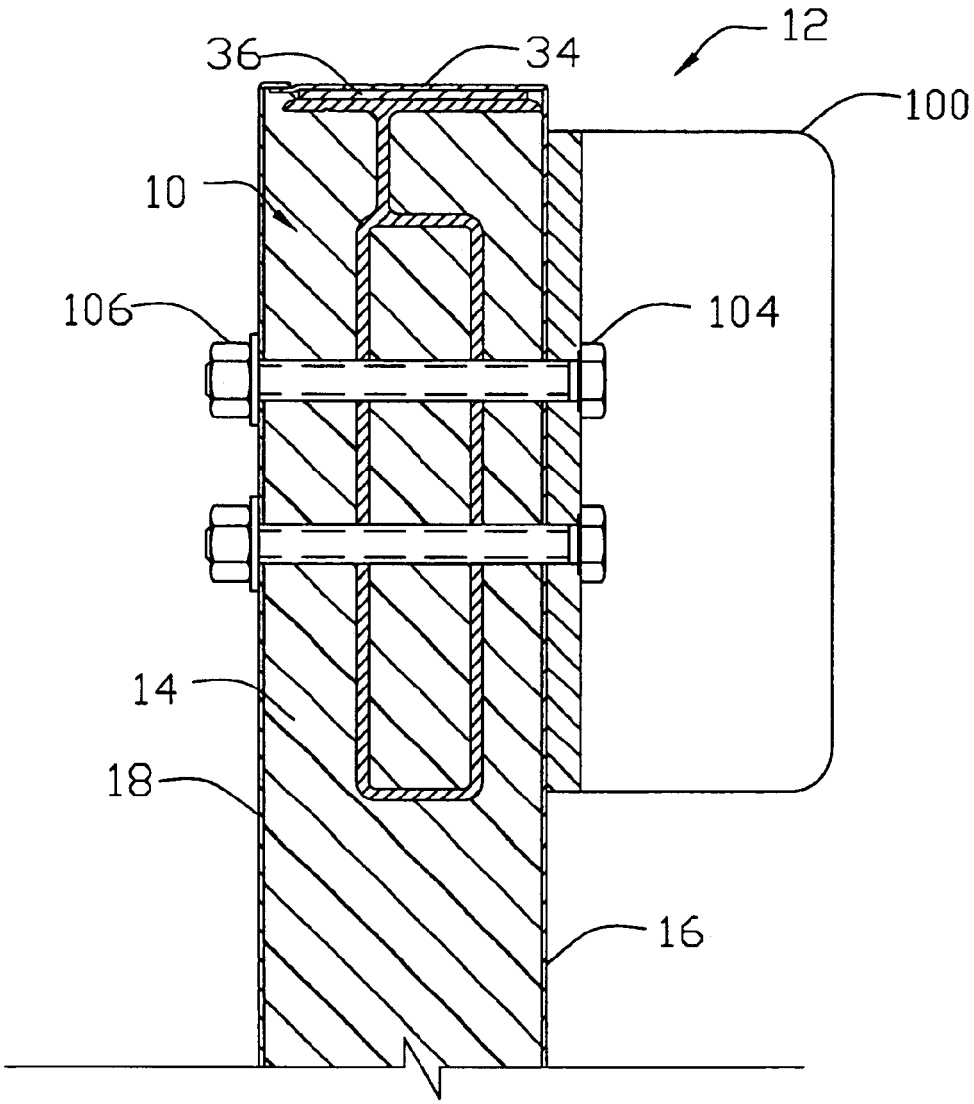
FIG. 7 is a cross sectional view of a hollow metal door with a tapping structure attached to an inside perimeter wall of a pan member and with fasteners retained by the thickness of the hollow metal door in accordance with the present invention.

With reference to FIGS. 5–7, the mounting surface 22, 32 of the tapping structure 10, 28 is attached to an inside perimeter wall 34 of the of the pan member 16, adjacent where a door component is to be attached, such as a closer 100. The tapping structure 22, 32 is preferably attached to an inside perimeter wall 34 of the pan member 16 with double sided tape 36, but other fastening methods may also be used. The hollow metal door having a foam retained tapping structure 1 is preferably assembled in the following manner. First, the at least one tapping structure 10, 28 is secured to an inside perimeter wall 34 of the pan member 16. Next, the lid member 18 is secured to the pan member 16. Finally, the hollow metal door 12 is injected with blown foam 14. The foam 14 fills the inner and outer perimeters of the tapping structure 10, 28 and retains the tapping structure securely in place. Preferably, the blown foam 14 is a urethane foam, but other blown foams may also be used.

There are at least three different methods of fastening the closer 100 or other door components to the hollow metal door 12. With reference to FIG. 5, holes are drilled through the pan member 16 and a single fastening wall 21, 31 of the tapping structure 10, 28, which align with fastening holes in the closer block 100. The adjacent fastening wall 21 will act as a stop for the drill. Self-tapping screws 102 are inserted through the closer 100 and screwed into the holes formed in the tapping structure 10, 28. With reference to FIG. 6, holes are drilled through the pan member and two fastening walls 21, 31 of the tapping structure 10, 28, which align with fastening holes in the closer block 100. Self-tapping screws 102 are inserted through the closer 100 and screwed into the holes formed in the tapping structure 10, 28. The fastening walls 21, 31 of the tapping structure 10, 28 provide superior screw holding strength to that of solid pine or oriented stran-board type materials.

With reference to FIG. 7, holes are drilled through the pan member 16, two fastening walls 21, 31 of the tapping structure 10, 28 and the lid member 18, which align with fastening holes in the closer block 100. Threaded bolts 104 are inserted through the closer 100, the pan member 16, the tapping structure 10, 28, the lid member 18 and retained with threaded nuts 106. The tapping structure 10, 28 provides added strength to prevent compression of the hollow metal door 12. Inserting a fastener into the tapping structure is defined as screwing into or inserting through the tapping structure.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of fastening a door component to a hollow metal door comprising the steps of:

providing said hollow metal door having a pan member and a lid member;

attaching a tapping structure to an inside perimeter wall of said pan member, said tapping structure having a fastening tube and a mounting surface that is formed on a perimeter of said fastening tube, fabricating said tapping structure from an extruded material;

attaching said lid member to said pan member;

injecting said hollow metal door with a blown foam; and attaching the door component to said hollow metal door by inserting at least one fastener into said tapping structure.

2. The method of fastening a door component to a hollow metal door of claim 1, further comprising the step of:

providing an attachment pedestal which extends from said fastening tube.

3. The method of fastening a door component to a hollow metal door of claim 2, further comprising the step of:

offsetting said attachment pedestal from a center of said fastening tube.

4. The method of fastening a door component to a hollow metal door of claim 1, further comprising the step of:

providing urethane foam for said blown foam.

5. The method of fastening a door component to a hollow metal door of claim 1, further comprising the step of:

attaching said tapping structure to said inside perimeter wall with a double aided tape.

6. A method of fastening a door component to a hollow metal door comprising the steps of:

providing said hollow metal door having a pan member and a lid member;

providing a tapping structure having a fastening tube and an attachment pedestal extending from said fastening tube;

attaching said attachment pedestal to an inside perimeter wall of said pan member;

attaching said lid member to said pan member;

injecting said hollow metal door with a blown foam; and attaching the door component to said hollow metal door by inserting at least one fastener into said fastening tube of said tapping structure.

7. The method of fastening a door component to a hollow metal door of claim 6, further comprising the step of:

offsetting said attachment pedestal from a center of said fastening tube.

8. The method of fastening a door component to a hollow metal door of claim 6, further comprising the step of:

fabricating said tapping structure from an extruded material.

9. The method of fastening a door component to a hollow metal door of claim 6, further comprising the step of:

providing urethane foam for said blown foam.

10. The method of fastening a door component to a hollow metal door of claim 6, further comprising the step of:

attaching said attachment pedestal to said inside perimeter wall with a double sided tape.

11. A method of fastening a door component to a hollow metal door comprising the steps of:

providing said hollow metal door having a pan member and a lid member;

providing a tapping structure with a fastening tube and a mounting surface that is formed on a perimeter of said tube;

attaching said mounting surface to an inside perimeter wall of said pan member;

attaching said lid member to said pan member;

injecting said hollow metal door with a blown foam; and attaching the door component to said hollow metal door by inserting at least one fastener into said fastening tube of said tapping structure.

12. The method of fastening a door component to a hollow metal door of claim 11, further comprising the step of:

fabricating said tapping structure from an extruded material.

13. The method of fastening a door component to a hollow metal door of claim 11, further comprising the step of:

providing urethane foam for said blown foam.

14. The method of fastening a door component to a hollow metal door of claim 11, further comprising the step of:

attaching said mounting surface to said inside perimeter wall with a double sided tape.

* * * * *